United States Patent [19]

Reid

[11] Patent Number: 4,516,941

[45] Date of Patent: May 14, 1985

[54] ROWING OUTRIGGER

[76] Inventor: Norman C. Reid, 5417 Vera Cruz Ave. North, Crystal, Minn. 55429

[21] Appl. No.: 541,959

[22] Filed: Oct. 14, 1983

[51] Int. Cl.[3] ..... B63H 16/06

[52] U.S. Cl. ..... 440/105; 114/347; 114/364

[58] Field of Search ..... 114/347, 363, 364; 440/104–110; 403/335, 336, 337, 227, 225

[56] References Cited

U.S. PATENT DOCUMENTS

| | | | |
|---|---|---|---|
| 1,037,990 | 9/1912 | Riggs | 440/105 |
| 1,650,418 | 11/1927 | Bjork | 440/107 |
| 2,857,189 | 10/1958 | Jeffery | 403/225 |
| 3,858,987 | 1/1975 | Kleinhans et al. | 403/337 |
| 3,958,289 | 5/1976 | Carlson | 114/347 |
| 4,290,156 | 9/1981 | Rawson | 440/108 |

FOREIGN PATENT DOCUMENTS

| | | | |
|---|---|---|---|
| 758146 | 1/1934 | France | 440/106 |

*Primary Examiner*—Galen L. Barefoot
*Assistant Examiner*—Edwin L. Swinehart
*Attorney, Agent, or Firm*—Palmatier, Sturm, Sjoquist & Baker, Ltd.

[57] ABSTRACT

A portable, lightweight outrigger for canoes and the like includes adjustable clamps for varying the disposition or reach of oarlock pivots with respect to the centerline of the canoe, self energizing clamps for resisting rowing torque and stabilizing the outrigger under operating conditions and reversible oar lock sockets to compensate for wear.

6 Claims, 10 Drawing Figures

Fig. 1.
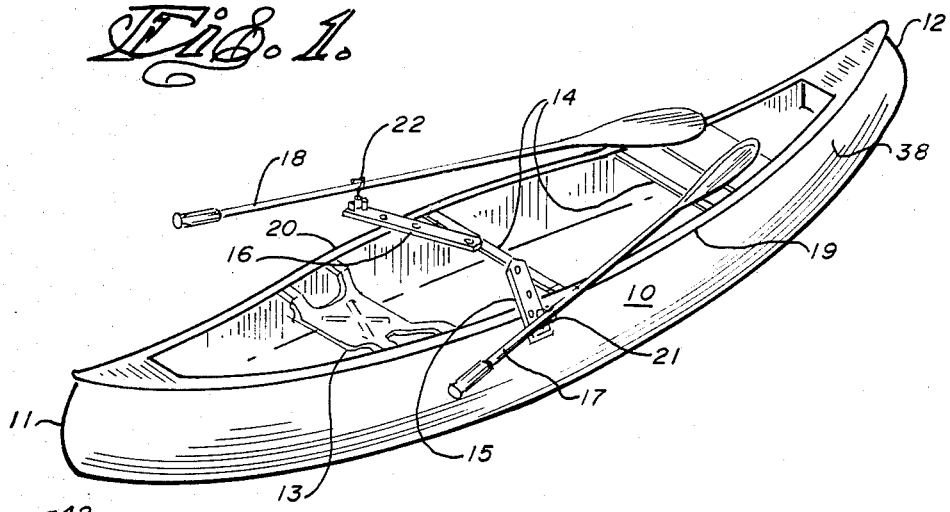
Fig. 2.
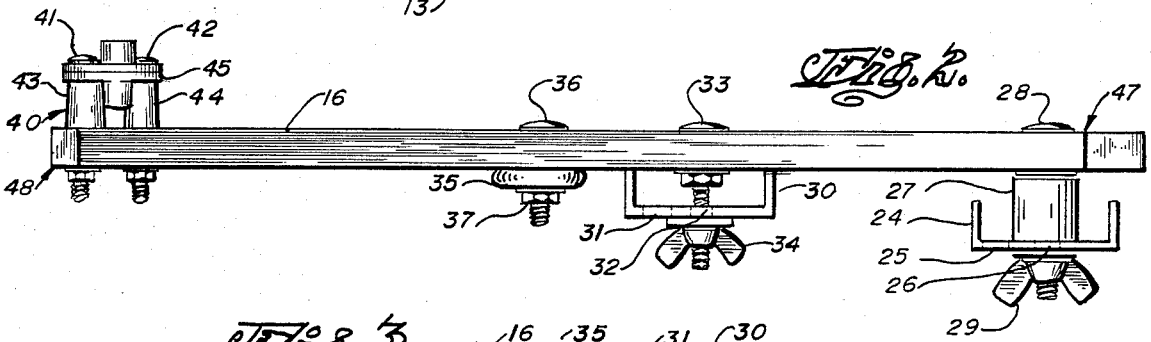
Fig. 3.
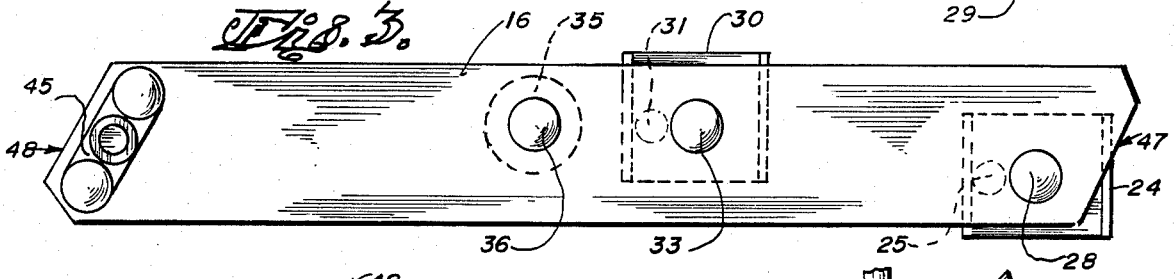
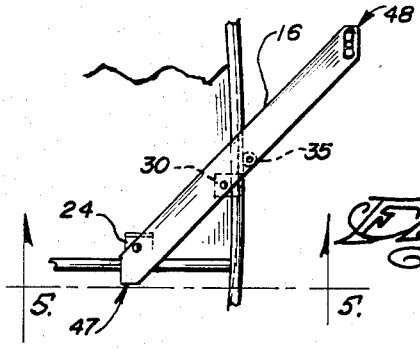
Fig. 4.
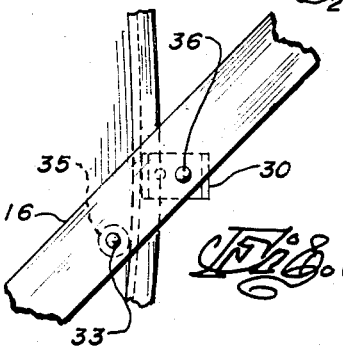
Fig. 6.
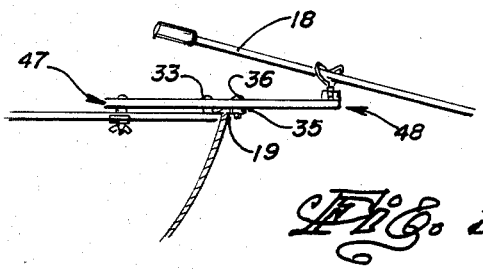
Fig. 5.
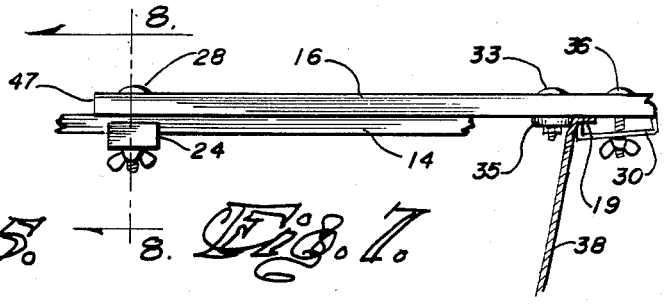
Fig. 7.

ROWING OUTRIGGER

BACKGROUND OF THE INVENTION

1. Field of the Invention

This invention relates to portable outriggers for disposition on canoes or the like to enable one to utilize oars instead of paddles for a more effective and efficient propulsion of the canoe under diverse conditions of operation. This invention is more particularly directed to a stable, lightweight and portable rowing outrigger that is adjustably, removably mounted to structural members of a canoe in such a manner as to firmly support the oarlock of an oar.

2. Description of Prior Art

A typical prior art apparatus for providing a rowing capability on a canoe is illustrated in the Andresen, Jr. U.S. Pat. No. 2,815,517, issued Dec. 10, 1957, for ROWING DEVICE. The device shown and described in the patent is comprised of a portable seat structure with side portions that overlie the gunwale of a canoe so that they may be clamped to the gunwale and includes outwardly extending portions having oarlock sockets at their outermost extremities. The illustrated invention is heavy and cumbersome and lacks adjustability and portability.

Other prior art known to me at the present time and having lesser degress of pertinency with respect to my invention are as follows:

| Patent No. | Dated | Inventor |
|---|---|---|
| 234,164 | 11/9/1880 | Armstrong |
| 276,220 | 4/24/1883 | Bond |
| 271,441 | 1/30/1883 | Fearon |
| 677,932 | 7/9/01 | Berry |
| 700,827 | 5/27/02 | Rollins |

SUMMARY OF THE INVENTION

My invention provides rowing outriggers that may be comprised of identically configured body members adapted to receive oarlock sockets at their outer extremities, gunwale clamps and stops at their intermediate portions and thwart clamps at their inner extremities. The outriggers are lightweight, easily portable and readily adjustable for use on canoes of various size and shape. The outriggers may also be left attached to the canoe during, for example, portaging activities.

My portable outriggers are further provided with a self energizing gunwale clamp intermediate the inboard and outboard ends whereby the forces generated by the reaction of an oar in operation serve to increase the lateral clamping engagement with the gunwale of the canoe without permanent distortion but with sufficient force to prevent a normal tendency toward creeping or slippage of the outrigger as the boat is being propelled through the water.

My outriggers are also adjustable both with respect to the size and shape of the structure of a canoe and the angular disposition of the outrigger with respect to the center line of the boat to provide a narrower, or wider, disposition of the oarlock sockets as may be occasioned by the preferences of a boater or the requirements determined by the length of the oars.

BRIEF DESCRIPTION OF DRAWINGS

These and other objects of my invention will become apparent from a consideration of the appended specification, claims and drawings in which:

FIG. 1 is a perspective sketch of a canoe showing a pair of my rowing outriggers in operative disposition thereon;

FIG. 2 is a side elevational view of one of the outriggers shown on FIG. 1;

FIG. 3 is a top plan view of the outrigger shown in FIG. 2;

FIG. 4 is a top plan fragmentary view of a thwart and starboard gunwale of a canoe showing my rowing outrigger mounted for use with an oar;

FIG. 5 is a side elevational view, partly in section of the apparatus of FIG. 4;

FIG. 6 is a top plan view of the intermediate portion of the outrigger shown in FIGS. 2, 3, 4 and 5 in operative disposition on the gunwale of a canoe;

FIG. 7 is a side elevational view, partly in section, showing the relationship of elements of the embodiment of FIG. 6;

DESCRIPTION OF THE PREFERRED EMBODIMENT

Figure 8:
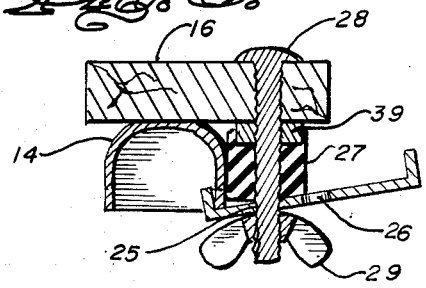
FIG. 8 is a sectional view taken along section line 8—8 of FIG. 7.

Referring to FIG. 1 of the drawings, there is shown a canoe 10 having a bow 11, a stern 12 and port and starboard gunwales 19 and 20. A bow seat 13 and a pair of thwarts 14 are shown disposed intermediate gunwales 19 and 20. A port outrigger 15 is shown extending over port gunwale 19 from thwart 14 and an oar 17 is shown in operative disposition in port oarlock 21 at the outboard end 48. Similarly, a starboard outrigger 16 is shown extending from thwart 14 over starboard gunwale 20 an oar 18 is shown operatively disposed in starboard oarlock 22 at the outboard end 48 thereof.

Referring to the remainder of the drawings wherein like elements have been identified by like reference characters, a starboard outrigger 16 is shown including a U-shaped thwart clamp 24, having mounting holes 25 and 26, and a resilient stop-snubber 27, disposed at inboard end 47 by the use of a suitable fastner means, shown in the form of a bolt 28 and nut 39, and wing nut 29 for adjustable, removable engagement with a thwart 14. An upwardly extending portion of U-shaped thwart clamp 24 and stop-snubber 27 are disposed on opposite sides of thwart 14.

A U-shaped gunwale clamp 30, having appropriately disposed holes 31 and 32, is adjustably disposed on a bolt 33 having a wing nut 34 and a resilient stop-snubber 35 is shown disposed on a bolt 36 and held by a nut 37 at a position intermediate the inboard and outboard ends 47 and 48 of outrigger 16. It may be noted that an upwardly extending vertical portion of U-shaped gunwale clamp 30 and snubber-stop 35 are disposed on opposite sides of starboard gunwale 19 formed at the top of hull 38 on canoe 10.

An oar lock socket 40 is disposed at the outboard end 48 of outrigger 16 and includes a pair of identical socket members 45 disposed on spacer members 43 and 44 and fastened in place with bolts 41 and 42.

It may be noted at this point that the outriggers may be comprised of any suitable lightweight material, such as wood, and that outriggers 15 and 16 are of complementary configuration and all that is necessary to form a starboard or port outrigger is to turn the body end for end and to place the hardware, comprised of the thwart clamp, the gunwale clamp and and snubber and oar lock socket 40 on the upper surface. It may also be noted that thwart clamp 24 and gunwale clamp 30 are provided with mounting holes that are preferably positioned off center with respect to the clamping ends so as to provide adjustability in mounting an outrigger on a given canoe, as will be explained in further detail below.

It may further be seen that a typical installation of my rowing outriggers on a canoe involves the steps of attaching the inboard ends to a thwart, 14, disposed at an appropriate location in the canoe in proximity to a seat for an operator and disposing the thwart clamps 24 on bolts 28, in relation to snubber 27 such that a snug engagement between snubber 27 and an outer vertically-extending clamp end of thwart clamp 24 is obtained and the functional engagement with thwart 14 is maintained through appropriate tightening of wing nug 29. A vertical leg of gunwale clamp 30 and snubber-stop 35 are disposed on opposite sides of the gunwale of a canoe 10 and stop-snubber 35 is disposed and held into engagement with one side of the gunwale by the position of the vertical leg of gunwale clamp 30 on bolt 33 (as provided by the adjustability afforded from offset holes 31 or 32) and held in place by wing nut 34. While the relationship of the elements in the illustrations of FIGS. 2–7 and 10 are for starboard outrigger 16, it is anticipated that one skilled in the art will readily understand the relationships and disposition of the corresponding elements as may be provided for a port outrigger, 15.

Referring to FIGS. 6 and 7, it may be noted that gunwale clamp 30 and stop-snubber 35 are reversed on bolts 33 and 36 respectively and, as such, are disposed on opposite sides of gunwale 20. This is provided to accommodate different forms of gunwales as may be appreciated from a consideration of FIGS. 5 and 7 in which gunwale 20 extends laterally inboard of canoe 10 in FIG. 5 and extends laterally outboard of canoe 10 in FIG. 7 and it may further be appreciated that the vertical leg of gunwale clamp 30, in either event, engages the bottom of the horizontal portion of gunwale 20 as well as the vertical portion of hull 38 so as to coact with snubber-stop 35 to securely engage gunwale 20.

Figure 9:
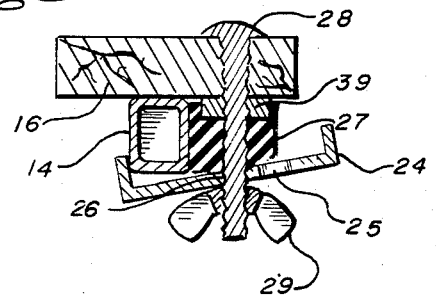
FIG. 9 is a further embodiment of FIG. 8.

FIGS. 8 and 9 illustrate two different clamping situations for thwart clamp 24 and snubber-stop 27 to accommodate different sizes and shapes of thwart members 14.

Referring to FIGS. 4 and 6, it may be appreciated that a force in a direction toward the bow of a canoe, or in the plan views of FIGS. 4 and 6, extending vertically toward the top of the page from the outboard end 48 of outrigger 16, tends to cause outrigger 16 to rotate in a counterclockwise direction to thereby cause gunwale clamp 30 and snubber-stop 35 to exert a pinching action on gunwale 20 so as to inhibit slipping of outrigger 16 along gunwale 20. The tendency toward counterclockwise rotation also causes a nominal initial rotation about thwart clamp 24, however, after a few strokes the system achieves a balance and outrigger 16 will remain firmly in operative position. It may further be noted that bolts 33 and 36 are disposed toward the stern of canoe 10 so as to prevent "lifting" of the rear portion of outrigger 16 under normal rowing forces.

Figure 10:
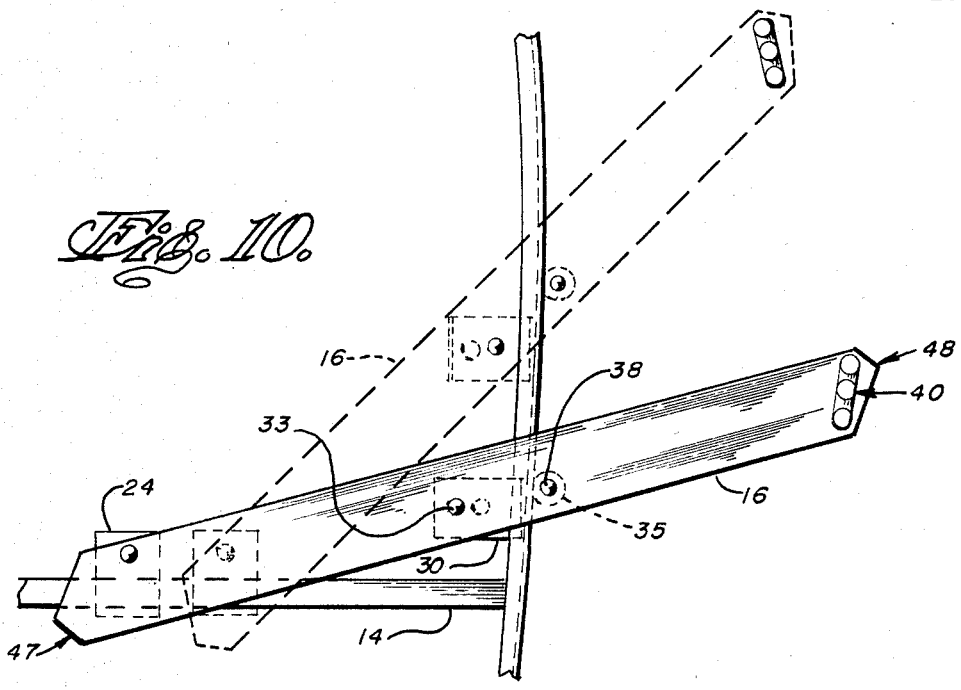
FIG. 10 is a top plan view illustrating further, the operation of my outrigger in operative disposition on relevant portions of a canoe.

FIG. 10 illustrates the relationship of the elements when gunwale clamps 30 are utilized to provide an adjustment in the lateral disposition of oarlock sockets 40 with respect to the centerline of the canoe. It may be appreciated that by utilizing different offset holes through the bottom of gunwale clamp 30 the resultant angular relationship with gunwale 20 and thereby the lateral disposition of oarlock sockets 40 between port and starboard outriggers 15 and 16 may be modified to accommodate oars of different lengths and/or the desires and likes of an operator.

Referring to FIGS. 2 and 3, the oarlock socket members 45 shown at the outboard end 48 of outrigger 16, may be reversed, top for bottom when the top of the oarlock receiving socket becomes enlarged due to operational wear and tear.

What is claimed is:

1. A portable rowing outrigger for one side of a canoe comprising, in combination;

a flat substantially rectangular and elongated outrigger base having inboard and outboard ends and upper and lower major surfaces;

means for operatively receiving an oarlock disposed at the upper outboard end of said base;

means extending downwardly of the bottom of said base for resiliently, frictionally engaging at least one side of a thwart of a canoe at the inboard end; and means extending downwardly of the bottom and disposed intermediate said inboard and outboard ends of said base for resiliently, frictionally engaging one side of the gunwale of a canoe and clampably engaging the other side and bottom of said gunwale whereby said elongated outrigger extends horizontally, angularly outwardly on the top of a canoe from a thwart, over said gunwale and said means for receiving said oarlock is disposed outwardly of the side of the canoe and said means for frictionally engaging said thwart and said gunwale are operable under propelling force applied to said oarlock to increase said frictional engagement with said thwart and said gunwale.

2. The apparatus of claim 1 in which the means for engaging the thwart of a canoe includes a downwardly extending resilient snubber to be disposed in frictional engagement with one side of a thwart of a canoe and U-shaped clamp means including a vertically disposed leg portion to be disposed on the other side of the thwart of a canoe.

3. The apparatus of claim 2 in which the clamp means is horizontally adjustable with respect to said means for resiliently engaging one side of the thwart.

4. The apparatus of claim 1 in which the means for clampably engaging the other side of the gunwale is of U-shaped cross section.

5. The apparatus of claim 4 in which the means for clampably engaging the other side of the gunwale is horizontally adjustable.

6. The apparatus of claim 1 in which the means for operatively receiving the oarlock includes a pair of generally flat members, each having an outwardly extending boss member and a bore therethrough, said last named members mounted in back-to-back relationship on top of a pair of spacer members.

* * * * *